US008875360B2

(12) United States Patent
Hunziker

(10) Patent No.: US 8,875,360 B2
(45) Date of Patent: Nov. 4, 2014

(54) MOBILE DRAWING-IN UNIT

(75) Inventor: Martin Hunziker, Maienfeld (CH)

(73) Assignee: Staubli AG Pfaffikon, Pfaffikon (CH)

( * ) Notice: Subject to any disclaimer, the term of this patent is extended or adjusted under 35 U.S.C. 154(b) by 412 days.

(21) Appl. No.: 13/140,499

(22) PCT Filed: Nov. 30, 2009

(86) PCT No.: PCT/CH2009/000381

§ 371 (c)(1),
(2), (4) Date: Aug. 3, 2011

(87) PCT Pub. No.: WO2010/069086

PCT Pub. Date: Jun. 24, 2010

(65) Prior Publication Data

US 2011/0283498 A1 Nov. 24, 2011

(30) Foreign Application Priority Data

Dec. 19, 2008 (EP) ..... 08405309

(51) Int. Cl.
*D03J 1/14* (2006.01)

(52) U.S. Cl.
CPC ..... *D03J 1/14* (2013.01)
USPC ..... 28/201; 28/205

(58) Field of Classification Search
CPC ..... D03J 1/14; D03J 1/00; D03J 1/13; D03J 5/20; D03J 2700/10; D03D 2700/84; D03D 51/22
USPC ..... 28/205, 203.1, 207.1, 208, 204, 201, 28/202, 206, 190, 193; 139/350, 91, 92, 139/93, 35
See application file for complete search history.

(56) References Cited

U.S. PATENT DOCUMENTS

| | | | | |
|---|---|---|---|---|
| 1,716,549 | A * | 6/1929 | Hammer | 28/202 |
| 3,136,025 | A * | 6/1964 | Noone et al. | 28/202 |
| 5,136,762 | A | 8/1992 | Gironi | |
| 5,184,380 | A * | 2/1993 | Benz et al. | 28/205 |
| 5,274,894 | A * | 1/1994 | Wilhelm et al. | 28/202 |
| 5,287,605 | A * | 2/1994 | Badertscher et al. | 28/207 |

(Continued)

FOREIGN PATENT DOCUMENTS

| | | |
|---|---|---|
| CH | 506643 A | 4/1971 |
| EP | 1384801 A1 | 1/2004 |

(Continued)

OTHER PUBLICATIONS

International Search Report for PCT/CH2009/000381 dated Feb. 15, 2010.

*Primary Examiner* — Amy Vanatta
(74) *Attorney, Agent, or Firm* — Pearne & Gordon LLP

(57) ABSTRACT

The invention relates to a mobile threading unit (10) for threading warp threads (20) of a warp into elements of a harness, having at least one providing apparatus (33, 43, 51) for providing elements of the harness, at least one receiving apparatus (32, 42, 51) for receiving elements of the harness with a threaded warp thread (20), a threading module (II) which is configured for separating an element from the at least one providing apparatus (33, 43), for gripping a respective warp thread (20), for threading said warp thread (20) into the separated element, and for placing the element with the threaded warp thread (20) on one of the receiving apparatuses (32, 42), wherein the threading unit (10) can be displaced spatially for threading individual warp threads (20).

20 Claims, 7 Drawing Sheets

(56) References Cited

U.S. PATENT DOCUMENTS

| | | | | | |
|---|---|---|---|---|---|
| 5,459,913 | A | * | 10/1995 | Lechner et al. | 28/208 |
| 5,475,906 | A | * | 12/1995 | Magdika | 28/205 |
| 5,514,234 | A | * | 5/1996 | Plaschy et al. | 156/148 |
| 5,775,380 | A | * | 7/1998 | Roelstraete et al. | 139/1 R |

FOREIGN PATENT DOCUMENTS

| | | | |
|---|---|---|---|
| JP | 06-057595 | A | 3/1994 |
| WO | 00/15888 | A1 | 3/2000 |
| WO | 00/61847 | A1 | 10/2000 |
| WO | 00/68479 | A1 | 11/2000 |

* cited by examiner

MOBILE DRAWING-IN UNIT

The invention relates to a mobile drawing-in unit for drawing in warp threads of a warp into elements of a weaving harness, a drawing-in machine having a stationary and a mobile part, and a corresponding drawing-in method.

Before a fabric or a material is produced on a weaving machine by joining warp threads and weft threads, the warp threads must be drawn into a weaving harness following a specific order. The elements of the weaving harness normally include heald frames, healds, drop wires and the reed. In this case, drawing-in means guiding each individual warp thread, which is normally wound on a warp beam in the required length, in each case into the thread guide of a drop wire, a heald and a gap between two teeth of the reed so that the end of the drawn-in warp thread then projects from the reed. The fabric pattern is predefined in this case by assigning the reed to a specific heald frame or introducing it into such a heald frame.

Since normally several hundred to several thousand warp threads are normally wound over a specific width in parallel on a warp beam, this process must be repeated precisely sufficiently frequently until a warp has been completely drawn into a weaving harness. This has been and still is carried out manually as before but machines are also available in various designs which either execute some of the processes (semi-automatic drawing-in machines) or the entire sequence automatically (automatic drawing-in machines).

Semi-automatic drawing-in machines are certainly relatively expensive but have the major disadvantage compared with automatic drawing-in machines that an operator is 100% occupied on the machine and executes the drawing-in process partly manually. In this way, only a slight increase in productivity can be achieved compared with manual drawing-in and the error rate is relatively high.

Automatic drawing-in machines are known and available on the market in various embodiments. They have an independent control for all the processes required for drawing-in warp threads into a weaving harness. The tasks of the operating staff are restricted to preparing and monitoring the sequence and the functions as well as the supply and removal of the starting material. The productivity can thus be increased many times compared with manual drawing-in and the error rate can be reduced substantially.

Known from the patent specification EP 0 460 129 is a drawing-in machine which has a needle-shaped drawing-in member, driveable in an oscillating manner, having a flexible gripper strip which bears a clamping gripper and which has a channel-like guide for the drawing-in member. This should ensure secure and reliable drawing-in of warp threads of all types.

The Japanese patent application JP 0 605 75 95 discloses a stationary drawing-in machine including a moveable machine frame for drawing-in warp threads.

The known disadvantages of such automatic drawing-in machines are, however, their high price, their relatively high space requirement and the fixed location inside the weaving mill. This must be selected so that an efficient flow of material is possible. A subsequent change in the location of a drawing-in machine is only possible with considerable installation effort and expenditure of time as well as interruption of production. This leads to high installation costs and large capacities which are possibly not used.

An advantage of the present invention consists in that the foregoing disadvantages are overcome and in particular a particularly flexible drawing-in of warps is rendered possible in an additionally simple and cost-effective manner.

An essential point of the invention consists in that the drawing-in unit according to the invention is flexible with regard to the location and additionally has a low space requirement. At the same time, its capacity is expandable, i.e. is suitable for a small requirement but can be expanded up to high capacities. Furthermore, only small basic investment costs are required for its procurement and operation.

Thus, in an advantageous embodiment of the drawing-in unit, it is provided that the elements of the weaving harness comprise at least one pair of heald bars and healds which can be placed on these heald bars, and the heald bars can be received in a receiving device and the healds can be fed in a feeding device and in which the drawing-in module is configured for placing the healds on the heald bars. In this case, the heald bars can already be fed in such a manner that they are held in lateral heald frames and inserted together with said heald frames into the receiving device. The basic elements of a weaving harness can thus be received and drawn in on the drawing-in unit. The set-up times are therefore restricted to this unit and not to the feeding of a warp beam bearing the warp to be drawn-in. The unit can thus be made available particularly rapidly and flexibly for drawing-in further thread layers.

In a further preferred embodiment of the drawing-in unit, it is additionally provided that the elements of the weaving harness comprise at least one drop wire supporting rail and drop wires which can be placed on this drop wire supporting rail, in which the drop wire supporting rail can be received in a receiving device and the drop wires can be fed in a feeding device, and the drawing-in module is configured for placing the drop wires on the drop wire supporting rail. As a result, further elements of a weaving harness can be received on the drawing-in unit and drawn in depending on the respective requirements of the desired weaving process. The drawing-in unit can thus be used more flexibly.

In yet another preferred embodiment of the drawing-in unit, it is additionally provided that the elements of the weaving harness comprise a reed which can be received in a receiving device, which is disposed after the healds when viewed in the direction of movement of the warp threads, and the drawing-in module is configured for drawing in the respective warp thread into relevant gaps of the reed and for gradually moving the reed further by a respective gap. As a result, the drawing-in unit can also be used more flexibly. The reed can thereby be held in the receiving device and moved further, for example, contrary to the direction of travel of the drawing-in unit by a suitable mechanism of the drawing-in module so that it remains positioned virtually spatially fixed with respect to the warp.

For operation of the drawing-in unit, this is preferably equipped with an independent compressed air supply and/or an electric power source. As a result, its flexibility is increased considerably since it is freed from cables and independent of external connections, i.e. it can be operated independently and is therefore spatially flexible.

In addition, a control module can be provided for automatic control of the drawing-in unit, in particular, for example, by its drawing-in module. A particularly easy movement of the drawing-in unit is preferably ensured by equipping this with an electric motor for the driving operation. Both these support a largely automated guidance of the unit in a production operation having, for example, a plurality of spatially separated weaving machines and warp beams.

For guidance of such a drawing-in unit, this is preferably equipped with a communication module for its wire-based and/or radio-based control. In a particularly preferred manner, guide cables for the drawing-in unit are laid in the floor of a production workshop, the unit being moved in a wireless independent manner therealong. Driving tasks can be transmitted to the unit in a wireless manner via radio signal.

In principle, the drawing-in unit need not have any specific chassis. Said unit can be moved on rails, for example, which however require previous laying. For movement of the unit, however, this is preferably equipped with wheels so as to ensure a particularly great flexibility.

The initially specified advantage of the present invention is achieved by a drawing-in machine which comprises a stationary part and a mobile part, wherein the stationary part comprises a clamping unit for a warp thread layer and the mobile part comprises the drawing-in unit.

An essential point of the drawing-in machine consists in that the position of the clamping unit can be selected so that it is optimally adapted to the material flow in the weaving mill. The structure of the machine according to the invention thus results in a particularly great flexibility.

The stationary part of the drawing-in machine thereby preferably comprises a clamping device for the warp thread layer. In addition, a retaining unit for a reed can be provided. The drawing-in unit can be transported along the thread layer and the reed for drawing in the warp threads into elements of the weaving harness, and the drawing-in module is configured for drawing in the respective warp thread into healds and/or drop wires and/or related gaps of the reed.

In a preferred embodiment of the method, each of the warp threads is drawn by respectively one appurtenant heald and/or respectively one appurtenant drop wire and/or respectively one appurtenant gap of a reed. Thus, optionally all the essential elements of a weaving harness can be integrated in the drawing-in process, thus ensuring a considerable flexibility with regard to the requirements of the desired weaving process.

Following the drawing-in of the warp into the elements of the weaving harness, the weaving harness with the drawn-in warp threads is removed from the drawing-in machine and the drawing-in machine is preferably positioned on a further thread layer or clamping unit. The drawing-in unit is therefore particularly rapidly available again for another drawing-in process, in which case it can be used completely flexibly spatially.

The mobile drawing-in unit according to the invention should accordingly also be used for operating spatially distributed clamping units with warp threads clamped in a thread layer.

The invention is explained in detail hereinafter with reference to the appended figures. The figures illustrate the individual process steps together with the units used in this case. As a result of the plurality of parts which are the same or have the same effect, these are characterised by the same reference numerals, thus ensuring a good overview. In the figures.

Figure 1:
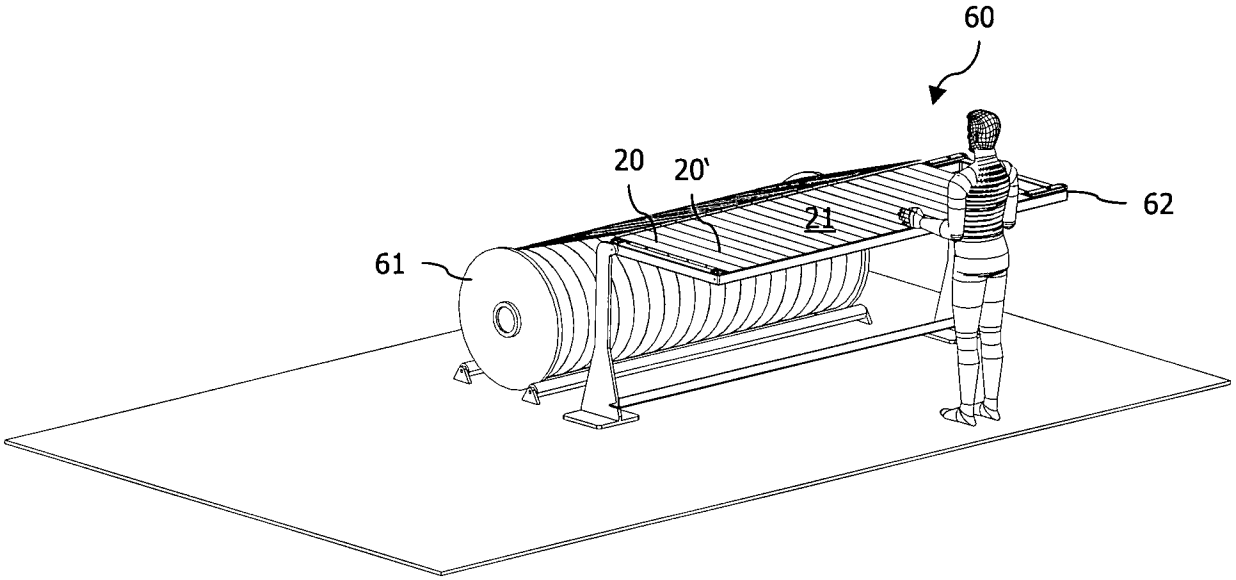
FIG. 1 shows a perspective view of a clamping unit with a warp thread layer of a warp beam inserted therein in the preparation position.

FIG. 1 shows a perspective view of a clamping unit 60 with a warp thread layer 21 of a warp beam 61 inserted therein in the preparation position. The normally positionally fixed clamping unit 60 has a vertically or horizontally pivotable thread frame 62 for clamping a warp thread layer 21 of individual warp threads 20, 20' of the warp beam 61. The width corresponds at least to the broadest thread layer 21 to be processed. The thread frame 62 has means for providing the thread layer 21 with the tension necessary for the processing. On the side of the thread frame 62, the clamping unit 60 can be additionally provided with a holder 70, shown in FIG. 7, for a reed into which the warp threads 20, 20' can be drawn in simultaneously during the drawing-in.

Figure 2:
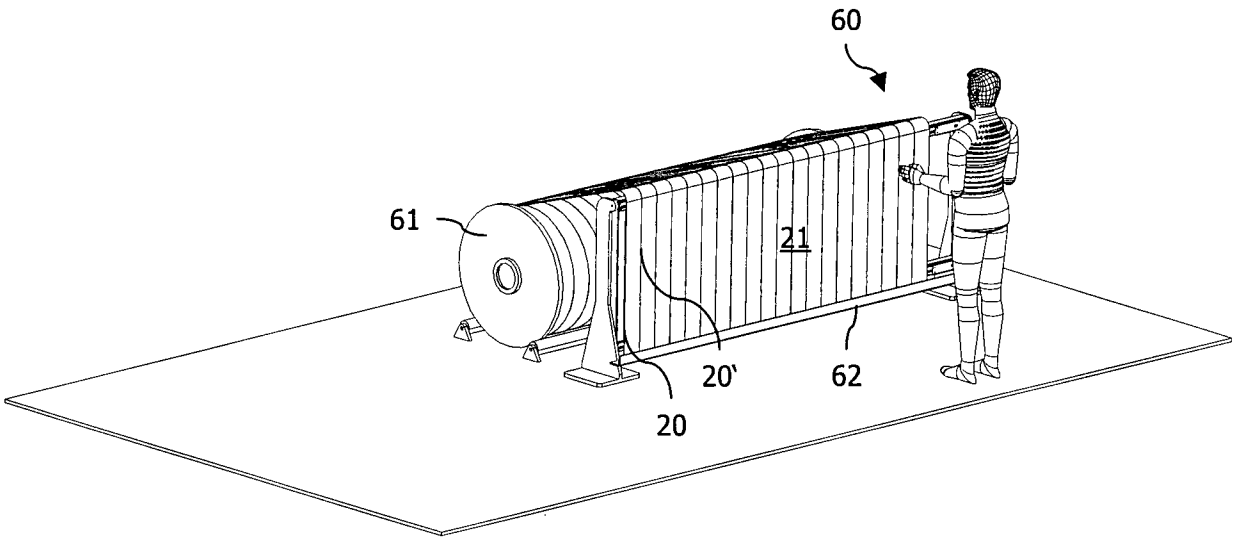
FIG. 2 shows the clamping unit of FIG. 1 in the drawing-in position, for positioning a drawing-in unit according to the invention.

FIG. 2 shows the clamping unit 60 from FIG. 1 in the drawing-in position, for positioning a drawing-in unit according to the invention. In this case, the thread frame 62 with the clamped warp thread layer 21 is folded vertically downwards for drawing-in the individual threads 21, 21'.

Figure 3:
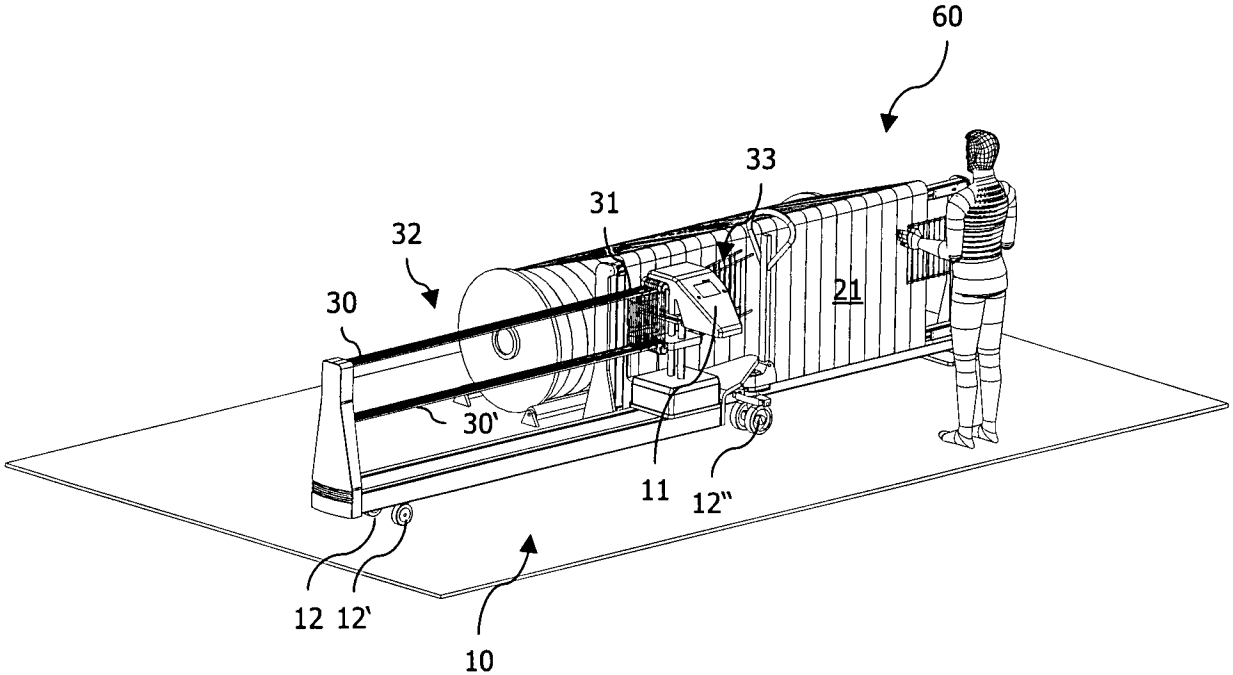
FIG. 3 shows a perspective view of a drawing-in machine according to the invention with a drawing-in unit and the clamping unit of FIGS. 1 and 2.

FIG. 3 shows a perspective view of a drawing-in machine according to the invention with a drawing-in unit 10 and the clamping unit 60 of FIGS. 1 and 2. The drawing-in unit is constructed on a drivable chassis with wheels 12 . . . 12" and consists of a receiving device 32 for heald bars 30, 30' on which healds 31 can be placed. A feeding device 33 is provided for magazining the healds 31. Disposed between the feeding device 33 for the healds 31 and the receiving device 32 for the healds with drawn-in warp thread 20, 20' is a drawing-in module 11 which separates the healds 31 from the feeding device 33, draws in a respective warp thread 20, 20' into thread eyes of the healds 31, and distributes the healds 31 onto the individual heald bars 30, 30'. The unit 11 furthermore has means for programming, operating and controlling the drawing-in machine.

Figure 4:
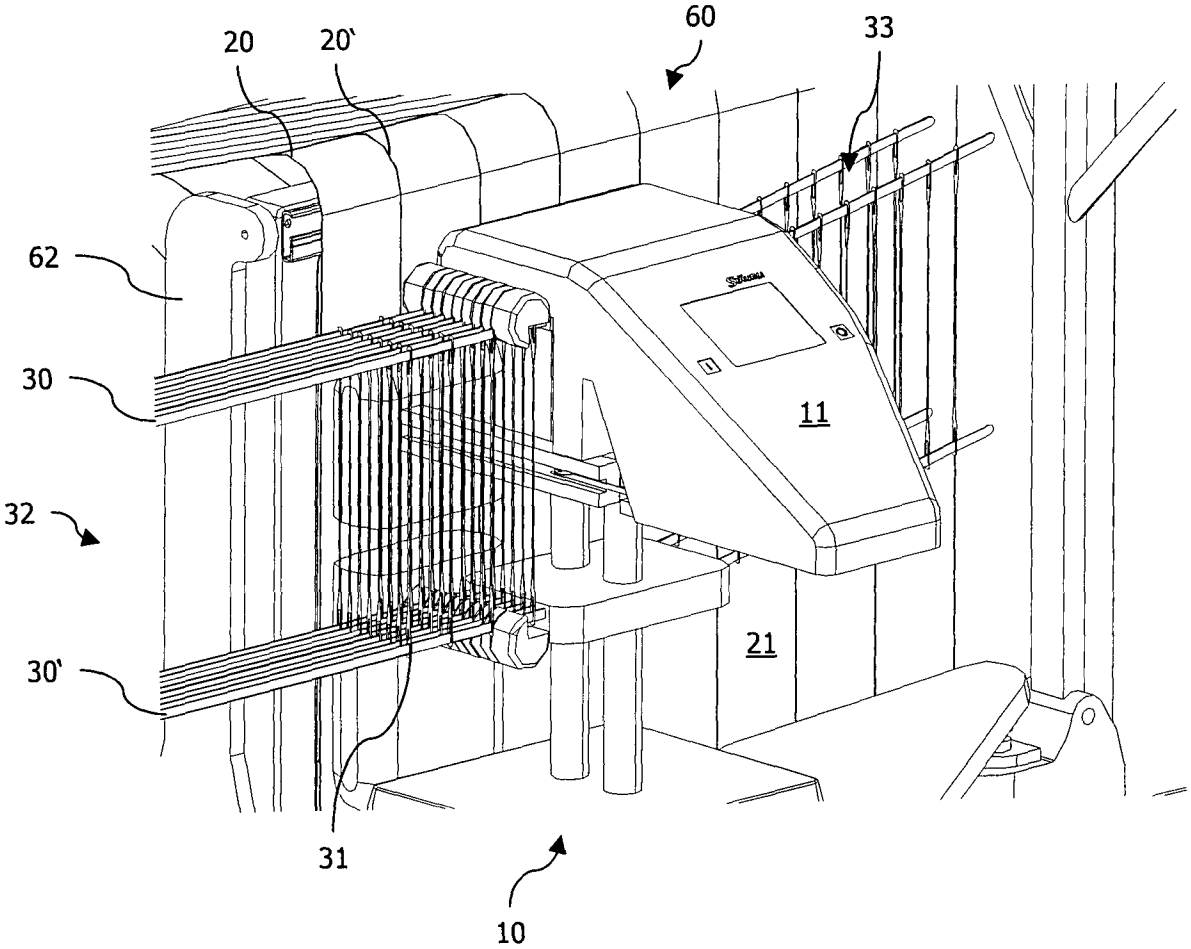
FIG. 4 shows an enlarged view of the drawing-in module of the drawing-in unit from FIG. 3 with a feeding and receiving device for healds.

FIG. 4 shows an enlarged view of the drawing-in module 11 of the drawing-in unit 10 from FIG. 3 with a feeding device 33 and receiving device 32 for healds 31. Shown spatially behind this is the clamping unit 60 in which a thread layer 21 of individual warp threads 20, 20' is clamped in its vertically placed thread frame 62. The threads 20, 20' gripped successively out from the drawing-in module 11 from the thread layer 21 are drawn into the healds 31 which are individually separated for this purpose from the feeding device 33 and are ultimately distributed with drawn-in warp thread 20, 20' on heald bars 30, 30'.

Figure 5:
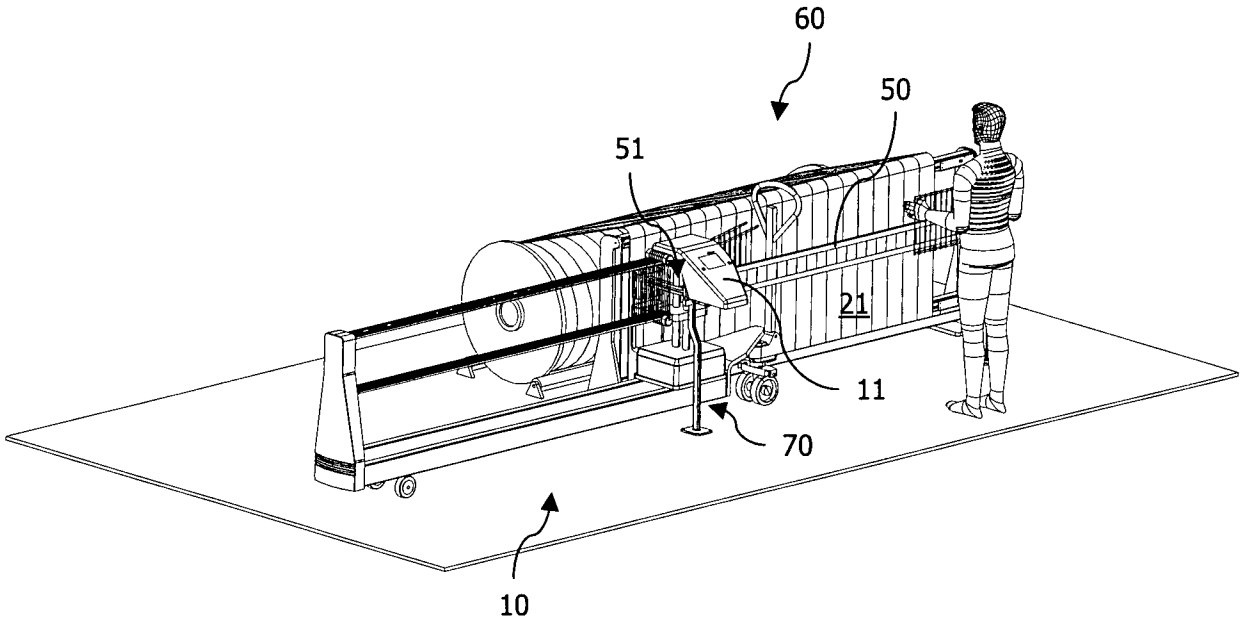
FIG. 5 shows a perspective view of the drawing-in machine according to the invention from FIGS. 3 and 4 with a retaining unit for a reed.

FIG. 5 shows a perspective view of the drawing-in machine according to the invention from FIGS. 3 and 4 with a retaining unit 70 for a reed 50. When such a reed 50 is to be used, it is inserted or clamped into the retaining unit 70 and received in a receiving device 51 of the drawing-in module 11 when the drawing-in unit 10 is positioned before the clamping unit 60. The drawing-in machine now consists of the stationary clamping frame 60 and the stationary retaining unit 70 (with reed 50) as well as the mobile drawing-in unit 10. The drawing-in module 11 is designed in this case so that as the drawing-in 10 is gradually moved along the thread layer 21, each warp thread 20, 20' is drawn into a heald 31 and into a gap of the reed 50.

Figure 6:
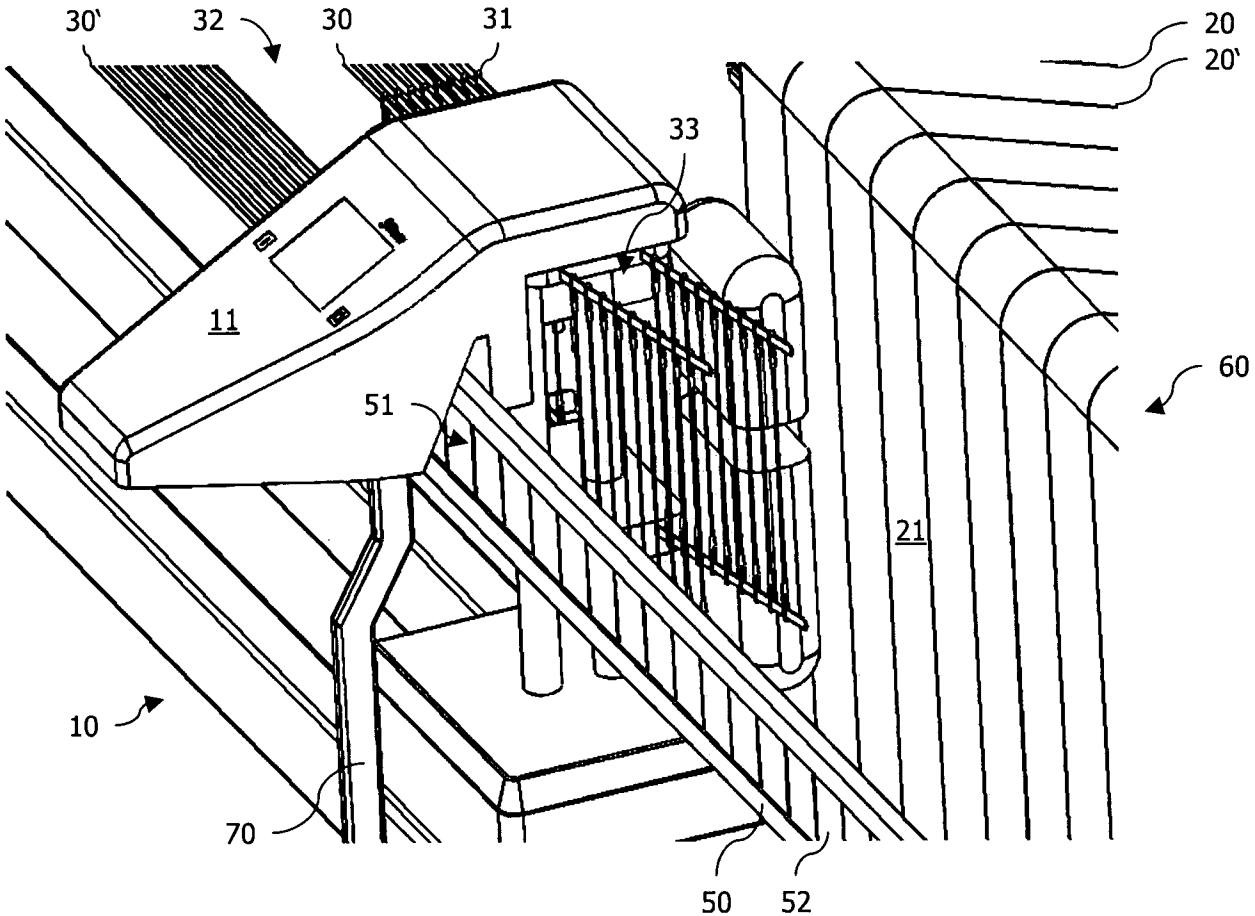
FIG. 6 shows an enlarged view of the drawing-in module of the drawing-in unit from FIGS. 3 to 5 with a receiving device for the reed and FIG. 7 shows a perspective view of the drawing-in machine from FIGS. 3 to 6 with a feeding and receiving device for drop wires.

FIG. 6 shows an enlarged view of the drawing-in module 11 of the drawing-in unit 10 from FIGS. 3 to 5 with a receiving device 51 for the reed 50 which is in turn held on the retaining unit 70. The drawing-in module 11 separates individual healds 31 from the feeding unit 33, grips a warp thread 20 from the thread layer 21 on the clamping unit 60, draws this thread 20 into a thread eye of the separated heald 31 and into a gap 52 of the reed 50 and places the heald 31 on the heald bars 30, 30' of the receiving device 32. The drawing-in unit 10 then moves on to the next warp thread 20' and repeats the drawing-in process until the last warp thread of the layer 21 is finally processed.

Figure 7:
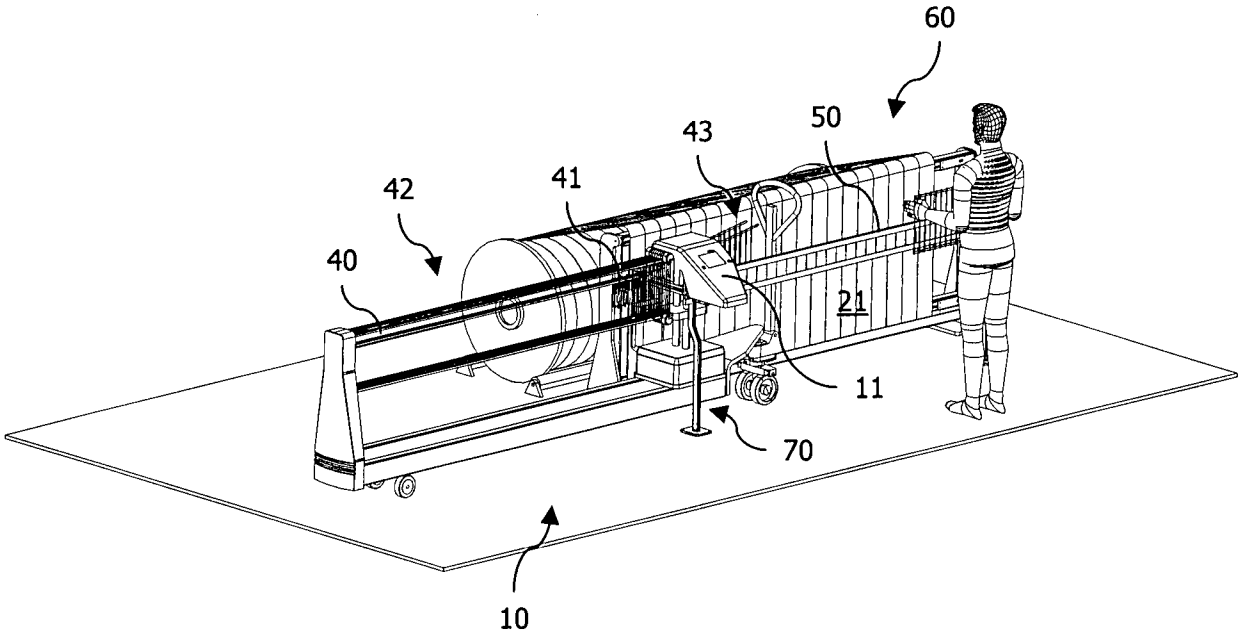

FIG. 7 shows a perspective view of the drawing-in machine from FIGS. 3 to 6 with a feeding and receiving device 43, 42 for drop wires 41. In this case, the drawing-in module is additionally configured for gradual separation of the drop wires 41 and for drawing-in a warp thread 20 from the thread layer 21 of the clamping unit 60 into a heald 31, a drop wire 41 and also into a gap 52 of the reed 50 and for placing the drop wire 41 on a drop wire supporting rail 40 of the receiving device 42. In principle, the module 11 can also undertake cutting of the warp threads 20, 20' and be provided with a corresponding cutting device.

A drawing-in process using the previously described drawing-in machine can accordingly be prepared and executed as follows.

The warp to be drawn in is firstly brought to the clamping unit 60 and the warp thread layer 21 is clamped on the thread frame 62. Depending on the preferred operating mode, this can take place in the horizontal or vertical position of the thread frame 62. After completion, the thread frame 62 is pivoted into the vertical. When using a reed 50, this can be clamped into the retaining unit 70 provided for this purpose.

The drawing-in unit 10 is then driven to the beginning of the warp thread layer 21. At the latest, the drawing-in unit is now prepared for the drawing-in by inserting a required number of heald bars or heald frames 30, 30' or drop wire supporting rails 40 into the receiving device 32, 42 provided for this purpose according to a drawing-in repeat pattern. In addition, the feeding device 33 or 43 for heald stacks or drop wire stacks is filled and a programming and/or input of the drawing-in repeat pattern is carried out.

The start of the drawing-in process is then triggered. The drawing-in of the warp threads 20, 20' takes place in a manner known per se in healds 31, drop wires 41 and the reed 50 until the last warp thread programmed according to the drawing-in repeat pattern. The healds 31 and drop wires 41 with warp threads 20, 20' drawn therein are distributed to the heald bars 30, 30' or drop wire supporting rails 40 provided for this purpose according to the drawing-in repeat pattern. The last warp threads 20, 20' drawn into the gaps 52 of the reed 50 project to the front from the reed 50.

During the drawing-in, the drawing-in unit 10 moves sideways from the beginning to the end of the warp thread layer 21 in accordance with the progress of the drawing-in. Once the end of the warp thread layer 21 is reached and the last warp thread 20, 20' is drawn in, the drawing-in unit 10 stands directly in front of the warp beam 61.

For take down, the reed 50 is released from the retaining unit 70, the heald bars 30, 30' with the healds 31 and the drop wire supporting rails 40 with the drop wires 41 are raised and removed together with the warp from the clamping unit 60. At the same time, the drawing-in unit 10 can be moved away. Clamping unit 60 and drawing-in unit 10 are thus free again for a next drawing-in process or its preparation.

Consequently, one or more clamping units 60 can be operated with a single drawing-in unit 10. This has the advantage that the capacity of the drawing-in unit 10 can be fully utilised when necessary since drawing-in can be effected almost without interruption on one of the clamping units 60 and only a brief interruption must be made for preparing and taking down and replacing the drawing-in unit 10.

During drawing-in, the frequently heavy warp beams 61 remain stationary. Motor drives for their forward movement are thereby omitted.

Depending on the material flow or topological design of the weaving mill, a single drawing-in unit 10 can serve several clamping units 60 located at a distance from one another such as, for example, in different weaving rooms. Thus, investment costs can be kept low and long transport distances, for example, for heavy warps, can be avoided.

Thanks to the mobility of the drawing-in unit 10, the maintenance of the machine can be carried out at any location and under optimal conditions. Maintenance work is thereby accomplished very efficiently and in a short time.

In addition, the drawing-in unit 10 can be designed to be self-propelled. In correspondingly configured surroundings and with the relevant installation, the drawing-in unit 10 can also be designed to be self-steering and can find its next deployment location independently and without being accompanied by an operator.

Such a person is only required for the preparation and take-down. During drawing-in, the installation runs independently. One person can therefore operate several drawing-in units 10 or clamping units 60.

What is claimed is:

1. A mobile drawing-in unit for drawing-in warp threads of a warp into elements of a weaving harness, comprising:

a feeding device for feeding an element of the weaving harness;

a drawing-in module configured to separate the element of the weaving harness from the feeding device, grip a warp thread, draw-in the warp thread into the element of the weaving harness, and place the element of the weaving harness on a receiving device, wherein the mobile drawing-in unit is spatially transportable, and wherein the mobile drawing-in unit is configured to draw-in warp threads of a first warp and to draw-in warp threads of a second warp, wherein the first warp includes a first clamping unit for clamping warp threads of the first warp and wherein the second warp includes a second clamping unit for clamping warp threads of the second warp, and wherein the mobile drawing-in unit is configured to be spatially mobile with respect to the first warp and the second warp, wherein the first warp is located at a distance from the second warp, and wherein the mobile drawing-in unit is further configured to be at least one of spatially mobile to and away from the first warp and spatially mobile between the first warp and the second warp.

2. The mobile drawing-in unit according to claim 1, comprising an independent compressed air supply and/or an electric power source configured to operate said mobile drawing-in unit.

3. The mobile drawing-in unit according to claim 1, comprising a control module configured to automatically control said mobile drawing-in unit.

4. The mobile drawing-in unit according to claim 1, comprising an electric motor configured to move said mobile drawing-in unit.

5. The mobile drawing-in unit according to claim 1, comprising a communication module configured to provide wire-based and/or radio-based control of said mobile drawing-in unit.

6. The mobile drawing-in unit according to claim 1, comprising wheels for moving said mobile drawing-in unit.

7. The mobile drawing-in unit according to claim 1, wherein the element of the weaving harness comprises at least one pair of heald bars and healds.

8. The mobile drawing-in unit according to claim 1 wherein the element of the weaving harness comprises at least one drop wire supporting rail and drop wires.

9. The mobile drawing-in unit according to claim 1 wherein the element of the weaving harness comprises a reed.

10. The mobile drawing-in unit according to claim 1, wherein the mobile drawing-in unit is configured to draw-in warp threads of different warps in different weaving harnesses, wherein each of the different warps comprises a clamping unit configured to clamp warp threads in a warp thread layer at a predetermined location, and wherein each of the different warps is located at a spatially different location.

11. The mobile drawing-in unit according to claim 7, wherein the healds are configured to be placed on the heald bars, and wherein heald bars are configured to be received in the receiving device, and wherein the healds are configured to be fed in the feeding device, and wherein the drawing-in module is configured to place the healds on the heald bars.

12. The mobile drawing-in unit according to claim 8, wherein the drop wires are configured to be placed on the drop wire supporting rail, and wherein the drop wire supporting rail is configured to be received in the receiving device, and wherein the drop wires are configured to be fed in the feeding device, and wherein the drawing-in module is configured to place the drop wires on the drop wire supporting rail.

13. The mobile drawing-in unit according to claim 9, wherein the reed is configured to be received in the receiving device, and wherein the drawing-in module is configured to draw-in the warp thread into a gap of the reed.

14. The mobile drawing-in unit according to claim 1, wherein the mobile drawing-in unit is further configured to be spatially mobile to and away from the second warp.

15. The mobile drawing-in unit according to claim 10, wherein the mobile drawing-in unit is configured to be at least one of spatially mobile to and away from the different warps and spatially mobile between the different warps.

16. A drawing-in machine for drawing in warp threads of a warp into elements of a weaving harness, comprising a stationary part and a mobile part, wherein the stationary part comprises a clamping unit for clamping the warp threads in a warp thread layer and wherein the mobile part comprises the mobile drawing-in unit according to claim 1, and wherein the mobile drawing-in unit is configured to be transported along the warp thread layer for drawing in the warp threads into elements of the weaving harness, and wherein the mobile drawing-in unit is configured to be spatially mobile with respect to a first stationary part and a second stationary part, wherein the first stationary part includes a first clamping unit for clamping warp threads of a first warp and wherein the second stationary part includes the second clamping unit for clamping warp threads of a second warp, and wherein the first stationary part is located at a distance from the second stationary part.

17. The drawing-in machine according to claim 16, wherein the stationary part further comprises a retaining unit for retaining a reed, and wherein the mobile drawing-in unit is configured to be transported along the warp thread layer and the reed, and wherein the mobile drawing-in unit is configured to draw in a warp thread into a gap of the reed.

18. A method for drawing-in warp threads of a warp into elements of a weaving harness, comprising the steps of:

(I) clamping warp threads in a first warp thread layer at a first predetermined location, (II) positioning a mobile drawing-in unit on the first warp thread layer;

(III) separating an element of the weaving harness from a feeding device, then (IV) gripping a warp thread, then (V) drawing in the warp thread into the element of the weaving harness, then (VI) placing the element of the weaving harness on a receiving device, then (VII) spatially transporting the mobile drawing-in unit along the first warp thread layer while performing steps (III), (IV), (V), and (VI), then (VIII) removing the weaving harness from the mobile drawing-in unit after performing step (VII), and then (IX) positioning the mobile drawing-in unit on a second warp thread layer at a second predetermined location after performing step (VIII), wherein the first warp thread layer is located at a distance from the second warp thread layer.

19. The method according to claim 18, wherein step (VII) is performed until a last warp thread of the first warp thread layer is draw-in.

20. The method according to claim 18, wherein step (IX) comprises moving the mobile drawing-in unit away from a first warp comprising the first warp thread layer and moving the mobile drawing-in unit between the first warp and a second warp comprising the second warp thread layer, wherein the first warp is located at a distance from the second warp.

* * * * *

UNITED STATES PATENT AND TRADEMARK OFFICE

CERTIFICATE OF CORRECTION

PATENT NO. : 8,875,360 B2
APPLICATION NO. : 13/140499
DATED : November 4, 2014
INVENTOR(S) : Martin Hunziker It is certified that error appears in the above-identified patent and that said Letters Patent is hereby corrected as shown below:

In the Specification,

Column 4, line 21; Please add -- 10 -- after "unit"

Column 8, line 16; Please delete "draw in" and add -- draw-in --

Signed and Sealed this
Fifth Day of May, 2015

Michelle K. Lee

Michelle K. Lee
*Director of the United States Patent and Trademark Office*